US005756152A

United States Patent [19]

Lin et al.

[11] Patent Number: 5,756,152

[45] Date of Patent: May 26, 1998

[54] CARPET HAVING IMPROVED APPEARANCE AND WEAR RESISTANCE

[75] Inventors: Tingdong Lin; Jing-peir Yu, both of Pensacola, Fla.

[73] Assignee: Monsanto Company, St. Louis, Mo.

[21] Appl. No.: 418,714

[22] Filed: Apr. 7, 1995

[51] Int. Cl.[6] ..... B05D 5/10

[52] U.S. Cl. ..... 427/207.1; 156/72; 427/389.9; 427/393.4; 428/92

[58] Field of Search ..... 427/389.9, 393.4, 427/207.1; 428/92–97; 156/72

[56] References Cited

U.S. PATENT DOCUMENTS

| | | | |
|---|---|---|---|
| 3,293,105 | 12/1966 | Koller | 161/67 |
| 3,347,736 | 10/1967 | Sissons | 161/67 |
| 3,494,819 | 2/1970 | McAlister, Jr. | 161/89 |
| 3,494,822 | 2/1970 | Weldon | 161/172 |
| 3,739,567 | 6/1973 | Williamson | 57/153 |
| 3,828,542 | 8/1974 | Boutonnet et al. | 57/140 |
| 3,877,214 | 4/1975 | Van der Werf | 57/164 |
| 3,978,267 | 8/1976 | Selwood | 428/360 |
| 4,374,884 | 2/1983 | Kwok et al. | 428/95 |
| 4,424,250 | 1/1984 | Adams et al. | 428/198 |
| 4,555,430 | 11/1985 | Mays | 428/134 |
| 4,871,064 | 10/1989 | Hackler | 428/96 |
| 5,032,333 | 7/1991 | Bankar | 264/103 |
| 5,141,780 | 8/1992 | Hackler et al. | 427/389.9 |
| 5,284,009 | 2/1994 | Tung et al | 57/239 |

FOREIGN PATENT DOCUMENTS

| | | |
|---|---|---|
| 62-117869 | 5/1987 | Japan . |
| 2 205 116 | 11/1988 | United Kingdom . |

*Primary Examiner*—Michael Lusignan

[57] ABSTRACT

A carpet having pile which is made up of fibers adhered to each other at points along their lengths with a chemically activated adhesive, as well as a process for treating a carpet, are disclosed. The carpet of the present invention is characterized by improved initial appearance and superior wear resistance when compared to prior art carpet constructions.

15 Claims, 1 Drawing Sheet

CARPET HAVING IMPROVED APPEARANCE AND WEAR RESISTANCE

BACKGROUND OF THE INVENTION

1. Field of the Invention

The present invention is directed to an improved carpet and a method for treating carpet. More specifically, the present invention is directed to a carpet having improved appearance and wear resistance and a method for improving the appearance and wear resistance of carpet.

2. Description of the Prior Art

Carpet, because of its warmth and pleasing aesthetics, has evolved to become a preferred flooring material in many homes as well as businesses. Manufacturers of carpet or carpet fiber continually search for carpet performance improvements in features such as static charge dissipation, staining, lightfastness and appearance. One particular performance area of current interest in the industry is the appearance retention of the carpet pile. As a carpet is subjected over time to traffic, soil and other items in its environment, the tufts which make up the pile tend to lose the twist that is typically imparted thereto, particularly at the very top portion of the tufts which form the pile surface. The identity of the individual tuft endpoints is thereby lost producing a worn appearance which is disliked by consumers. Further, tufts tend to matt, or permanently bend or lean, again producing an undesirable worn appearance.

Numerous solutions have been proposed in the prior art to address the problem of carpet wear resistance or appearance retention. For example, as disclosed in WO88/03969, it is known to add heat-activated binder fibers in carpet yarns to improve retention of tuft identity and increase wear resistance. Similarly, U.S. Pat. No. 5,284,009 discloses ply-twisted carpet yarn including base fibers and low-melt polyolefin fibers which melt and bond to each other (but not to the base fibers) when the yarn is heat-set. It is also known from U.S. Pat. No. 4,871,604 to improve carpet wear resistance by applying a binder powder to the pile surface of a carpet and heating the carpet to melt the powder and bond fibers within the yarn that makes up the pile.

All of these known prior art processes share the disadvantage of requiring a heating step to effect activation of an adhesive. Such a heating step can involve increased processing costs and capital investment. Further, such heating could affect or even destroy the appearance and performance characteristics of the carpet or pile fiber unless carefully controlled. For example, heating may decompose the base fiber or otherwise introduce an undesirable yellowness to the fiber. Also, once the adhesive is present, careful control of the temperature during subsequent processing is necessary to avoid premature activation of the adhesive.

A need therefore exists for a carpet with improved initial appearance and increased wear resistance as well as for a process for treating a carpet which improves the initial appearance and wear resistance of the pile.

BRIEF SUMMARY OF THE INVENTION

The present invention satisfies these needs and achieves the other benefits set forth in detail below by providing a carpet having pile which is made up of fibers adhered to each other at points along their lengths with a chemically activated adhesive. The carpet of the present invention is characterized by improved initial appearance and superior wear resistance when compared to prior art carpet constructions. The process of the present invention successfully provides a carpet with the above characteristics without the need for a heating step and with improved controllability of adhesive application.

DETAILED DESCRIPTION OF THE DRAWINGS

DETAILED DESCRIPTION OF THE PREFERRED EMBODIMENTS

Figure 1:
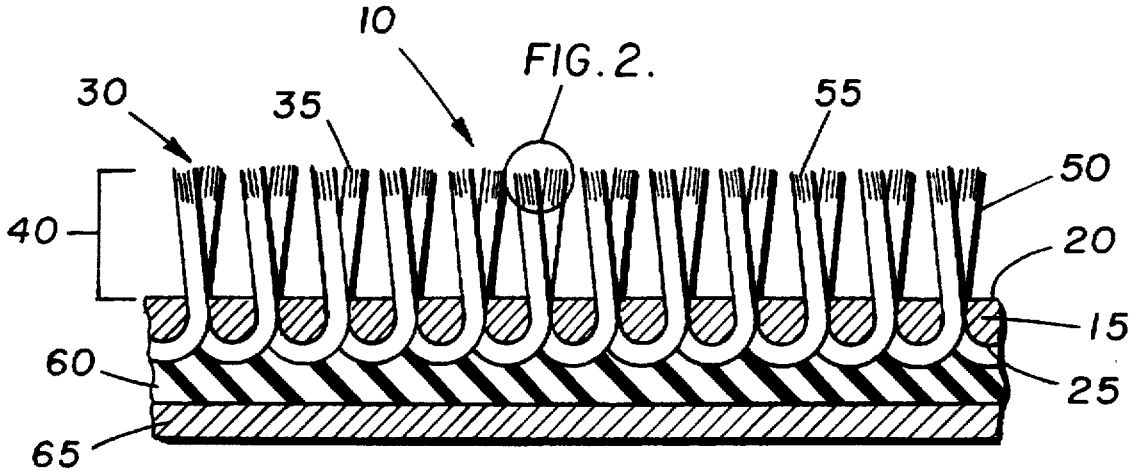
FIG. 1 is a plan view of the carpet of the present invention.
Figure 2:
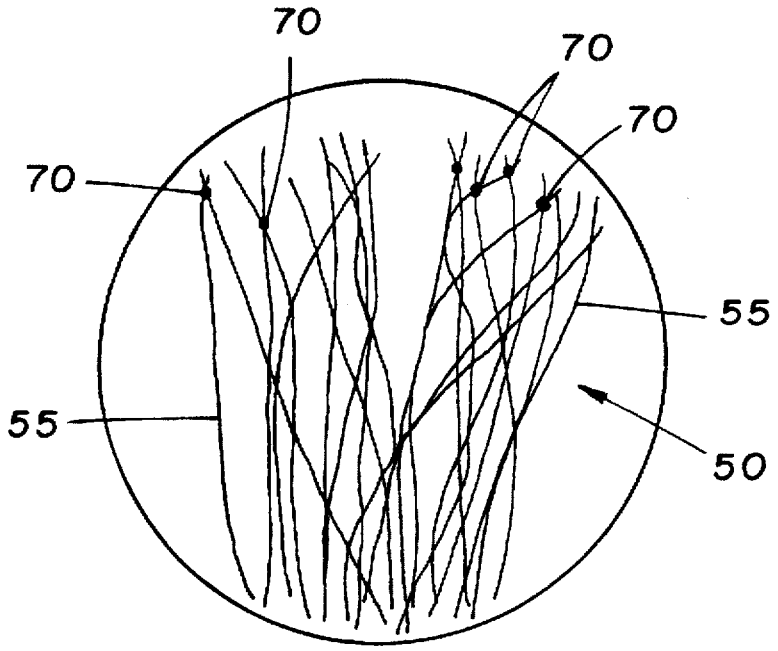
FIG. 2 is an enlarged plan view of the encircled portion of FIG. 1.

The carpet of the present invention includes pile yarn having fibers which are adhered to each other at points along their lengths with a chemically activated adhesive. The carpet 10 generally includes a primary backing 15 having a top face 20 and an underside 25 and pile 30 including fibers 55 and extending outwardly from the top face 20 of the backing 15. The pile 30 includes a top surface 35 at a pile height or thickness 40 extending outwardly from the top face 20 of the backing 15 of preferably about 0.6 cm to 2.5 cm. The pile 30 is formed from carpet yarn 50 which is tufted into the backing 15 and which includes fibers 55. The term "fibers", as utilized herein, is defined to include continuous filaments as well as staple fibers formed therefrom. The fibers 55 may be natural fibers, for example cotton or wool, or synthetic fibers such as polyester, polyolefin or polyamide fibers. Preferred fibers are polyamide fibers such as nylon 6,6 fibers.

The carpet preferably further includes an adhesive layer 60 applied to the underside of the primary backing 15 to provide dimensional stability to the carpet 10 and to lock the tufted carpet yarn 50 into the backing 15. The carpet most preferably further includes a secondary backing 65 adhered to the primary backing 15 by the adhesive layer 60. The adhesive layer 60 is preferably a styrene-butadiene rubber applied as a latex while the backings 15 and 65 are preferably woven or non-woven fabrics formed from a polyolefin, for example polypropylene.

The fibers 55 of the pile 30 of the present invention are adhered to each other at points of adhesion 70 along their lengths by a chemically activated adhesive. The phrase "chemically activated adhesive", as utilized herein, is defined to include any material whose adhesive qualities have been actuated by a chemical activator such as, for example, a solvent, emulsifier, dispersant or reactant for the adhesive. Similarly, the term "chemically activatable adhesive", as utilized herein, is defined to include any material having potential adhesive qualities which may be actuated by a chemical activator such as, for example, a solvent, emulsifier, dispersant or reactant for the adhesive. A chemically activatable adhesive therefore can become a chemically activated adhesive by activation via, for example, dissolution, emulsification, dispersion or reaction of the activatable adhesive.

The quantity and type of chemically activated adhesive are selected such that the appearance of the carpet of the present invention is better with respect to tuft endpoint definition and lack of matting, according to the test below, than carpet wherein said points of adhesion are not present. As discussed above, maintenance of tuft endpoint definition and resistance to matting are considered indicators of carpet appearance retention, a characteristic desired by most consumers.

Examples of suitable adhesives include, without limitation, vinyl acetate/acrylic copolymers, vinyl butyral/ vinyl alcohol/vinyl acetate terpolymers, acrylic/urethane copolymers, vinyl acetate/ethylene copolymers, isocyanate/urethane copolymers, aqueous epoxies, and the like. Preferably, the chemically activated adhesive is a nonmelting adhesive. The term "nonmelting", as utilized herein, is defined to include materials which, when exposed to increasing temperatures, do not undergo a primary phase transition but rather exhibit a marked change in heat capacity and increased molecular motion and flowability. Many crosslinked polymers, for example, are characterized by a glass transition temperature but no melt point and are therefore nonmelting. A preferred nonmelting, chemically activated adhesive is an emulsified vinyl acetate/acrylic copolymer such as that commercially available from Air Products and Chemicals under the trade name FLEX-BOND® 325.

The amount of chemically activated adhesive present in the carpet of the present invention may vary greatly depending on, for example, the particular adhesive, the pile type and pile weight of the carpet and the adhesive application method. Preferably, the adhesive is present in the amount of from 0.30% to 8.50% by weight based on the total weight of the pile. Most preferably, the points of adhesion 70 are present at the surface 35 of the pile 30 as well as at least partially in the height or thickness 40 of the pile 30.

Most preferably, the chemically activated adhesive further includes a wetting agent. Suitable wetting agents include nonionic wetting agents, for example, polyethylene oxide (4) isodecyl ether or polyethylene oxide (6) decyl alcohol; and anionic wetting agents, for example, sodium dodecylbenzene sulfonate. A particularly preferred wetting agent includes polyethylene oxide (6) decyl alcohol commercially available from Ethox Chemical Company as ETHAL DA-6. The wetting agent is useful in promoting migration of the adhesive into the thickness 40 of the pile 30 during application thereof thereby promoting formation of points of adhesion 70 between and along the lengths of fibers 55 in the thickness 40 of the pile as well as at the surface 35 thereof. The wetting agent is most preferably present in an amount of from 0.03% to 0.80% by weight based on the total weight of the pile.

The carpets of the present invention exhibit improved appearance retention as measured by the following test, which provides a means by which the appearance retention of a carpet of the present invention can be compared to other "control" carpets, for example carpet in which the points of intersecting fibers bonded with a chemically activated adhesive are not present.

One or more samples of the carpet of the present invention as well as a sample of "control" carpet are subjected to a walk test wherein individuals walk on the surface of the sample with each occurrence of walking called a "traffic." The samples are subjected to 100,000 traffics in this test.

The trafficked carpets are then each compared by a skilled grader to a set of reference carpets which have been assigned numeric appearance retention grades from 1 to 7, with 1 denoting best and 7 denoting worst appearance retention with respect to tuft endpoint definition and lack of matting. Color appearance and effects are not taken into consideration. Each sample is then assigned an appearance grade (AR) based on the comparison of that sample with the reference standards. ΔAR for each test sample is then calculated as $$\Delta AR = AR_{control} - AR$$

As lower numerical AR grades are indicative of better appearance retention with respect to tuft endpoint definition and lack of matting, positive ΔAR values are indicative of better appearance retention versus a control.

The process for treating a carpet according to the present invention includes providing a chemically activatable adhesive as defined above; activating the chemically activatable adhesive; and applying the adhesive to the carpet pile to adhere the fibers of pile to each other at points of adhesion along their lengths such that the tuft endpoint definition and lack of matting of the carpet is better than a carpet in which the points of adhesion were not present. Any material fitting the above definition for "chemically activatable adhesive" would be suitable for the first step in the process. A preferred chemically activatable adhesive is a nonmelting chemically activatable adhesive such as a vinylacetate/acrylic copolymer commercially available in an activated form from Air Products and Chemicals under the trade name FLEX-BOND® 325.

With respect to the next step in the process, the chemically activatable adhesive may be activated by dissolution, emulsification, dispersion or reaction of the adhesive. In a preferred embodiment, the activation step includes forming an emulsion of the adhesive. Emulsifying agents which are useful for this forming step are well known in the art and will depend upon the specific activatable adhesive which is utilized. The amount of adhesive in the emulsion will vary depending on the emulsion application rate and the desired amount of chemically activated adhesive in the final carpet. Preferably, the adhesive is present in the emulsion at an amount sufficient to provide from 0.30% to 8.50% of the adhesive for the pile. A suitable amount of adhesive in the emulsion ranges from 1.5% to 15.0% based on the total weight of the emulsion.

The next step in the process of the present invention is applying the activated adhesive to the carpet pile. The activated adhesive bonds the fibers which makes up the pile to each other at points of adhesion along their lengths. This application step can be performed using known methods and devices typically utilized for coating applications such as roll coating, dip coating, spray coating and the like. In the preferred embodiment wherein the activation step includes forming an emulsion of the adhesive, the application step includes spraying the adhesive on the pile.

A particularly preferred application step includes applying the activated adhesive under conditions sufficient to form points of adhesion between fibers at the surface of the pile as well as in the height of the pile. Most preferably, the application step is performed in the presence of a wetting agent. As discussed above, the wetting agent is useful in promoting migration of the adhesive into the height or thickness 40 of the pile 30 during application thereof thereby promoting formation of points of adhesion 70 between fibers 55 at least partially in the height or thickness 40 of the pile 30 as well as at the surface 35 of the pile 30. The wetting agent can be supplied together with the activated adhesive or separate from the activated adhesive during the application step. The amount of wetting agent present can vary greatly depending on, for example, the adhesive application rate, type or amount of adhesive and amount of wetting agent desired on the final product. Preferably, the wetting agent is present in the amount sufficient to provide from 0.03% to 0.80% wetting agent based on the total weight of the pile in the final carpet product.

The next step in the process of the present invention includes removing any excess chemical activator from the pile 30. This step may be most simply performed by exposing the pile 30 to ambient conditions which are sufficient to evaporate any excess chemical activator over time.

Most preferably, this step is performed in the absence of added heat, especially in the particularly preferred embodiment wherein a nonmelting chemically activatable adhesive is utilized; however, the activator removal step may be performed in the presence of a limited amount of added heat, preferably at a temperature below about 100° C., to promote or expedite removal of excess activator.

The following example, while not intended to limit the scope of the present invention, is provided to describe in greater detail the carpet and process of the present invention.

Example

A large carpet sample, approximately 0.6 m wide by 64 m long, was procured. The carpet had the following specifications:

Pile: Nylon 6,6

Pile Weight: 32 oz/sq yd (1086 g/sq m)

Pile Height: 0.25 in (0.635 cm)

Primary Backing: Nonwoven Polypropylene

Adhesive: $CaCO_3$-Filled SBR

Secondary Backing: Woven Polypropylene

The large sample was divided into smaller samples for application of the chemically activated adhesive as set forth below.

A sample of an emulsified vinylacetate/acrylic copolymer adhesive available from Air Products and Chemicals under the trade name FLEXBOND® 325 was procured. The emulsion sample contained about 55% by weight of the adhesive based on the total weight of the emulsion. The sample was reformulated to contain about 2.75% of the adhesive based on the total weight of the emulsion.

The adhesive emulsion was applied to each of the samples (except a control) as listed in the table below with the amount of adhesive varied between samples. The adhesive was applied by spraying through a series of nozzles. In the samples below, the adhesive was applied in the presence of a wetting agent, polyethylene oxide (6) decyl alcohol, the amount of which was varied between samples. Where indicated below, the surface of the carpet sample was lightly contacted with a knife edge after the adhesive was applied to promote adhesive application uniformity and bonding of pile fibers within the height of the pile.

TABLE 1

| | P | WA | |
|---|---|---|---|
| Carpet ID | lb/yd² (kg/m²) | lb/yd² (kg/m²) | Blade |
| 1 (control) | 0.000 (0.000) | 0.0000 (0.0000) | no |
| 2 | 0.023 (0.012) | 0.0017 (0.0009) | no |
| 3 | 0.023 (0.012) | 0.0017 (0.0009) | yes |
| 4 | 0.046 (0.025) | 0.0017 (0.0009) | no |
| 5 | 0.046 (0.025) | 0.0017 (0.0009) | yes |
| 6 | 0.046 (0.025) | 0.0050 (0.0027) | no |
| 7 | 0.046 (0.025) | 0.0050 (0.0027) | yes |
| 8 | 0.068 (0.037) | 0.0017 (0.0009) | no |
| 9 | 0.068 (0.037) | 0.0017 (0.0009) | yes |
| 10 | 0.091 (0.049) | 0.0017 (0.0009) | no |
| 11 | 0.091 (0.049) | 0.0017 (0.0009) | yes |
| 12 | 0.046 (0.025) | 0.0017 (0.0009) | no |

The carpet samples, including the control, were then tested for appearance retention (AR) according to the procedure described above. The results are tabulated in Table 2 below.

TABLE 2

| SAMPLE NO. | AR | ΔAR |
|---|---|---|
| 1 (control) | 5.0 | — |
| 2 | 4.0 | +1.0 |
| 3 | 4.0 | +1.0 |
| 4 | 4.5 | +0.5 |
| 5 | 4.0 | +1.0 |
| 6 | 5.0 | 0 |
| 7 | 5.5 | −0.5 |
| 8 | 6.0 | −1.0 |
| 9 | 6.0 | −1.0 |
| 10 | 5.0 | 0 |
| 11 | 4.0 | +1.0 |
| 12 | 4.0 | +1.0 |

As shown from the above data, the carpet of the present invention demonstrated appearance retention characteristics superior to the untreated control sample in a majority of the tested items.

While the present invention has been described in detail and exemplified above, it is to be understood that various modifications may be made to the spirit and scope of the invention which do not depart from its spirit and scope. For example, various additives may be applied along with the activated adhesive in the present process to improve other characteristics of the carpet so long as such additives do not detract from the appearance retention of the carpet. Further, the process may also include additional steps including, for example, contacting or rubbing the pile after the activated adhesive is applied, to promote the formation of points of adhesion with the height of the carpet pile.

We claim:

1. A process for treating a carpet, said carpet including at least one backing material having a top face and an underside and pile comprising fibers and having a top surface and a thickness extending outwardly from said top face of said backing material, said process comprising:

(a) chemically activating a chemically activatable adhesive; and thereafter (b) applying said adhesive to said pile to adhere said fibers to each other at points of adhesion along their lengths.

2. The process of claim 1 wherein said chemical activation step includes forming an emulsion of said chemically activatable adhesive.

3. The process of claim 2 wherein said application step is conducted under conditions sufficient to form points of adhesion between said fiber at the surface of said pile as well as in the height of said pile.

4. The process of claim 3 wherein said application step is conducted in the presence of a wetting agent.

5. The process of claim 1 wherein said chemically activatable adhesive includes a non-melting chemically activatable adhesive.

6. The process of claim 5 wherein said adhesive is a vinyl acetate/acrylic copolymer.

7. A process for treating a carpet, said carpet including at least one backing material having a top face and an underside and pile comprising fibers and having a top surface and a thickness extending outwardly from said top face of said backing material, said process comprising:

(a) chemically activating a chemically activatable adhesive; and thereafter (b) applying said adhesive to said pile to adhere said fibers to each other at points of adhesion along their lengths; wherein said application step is conducted in the presence of a wetting agent.

8. The process of claim 7 wherein said chemical activation step includes forming an emulsion of said chemically activatable adhesive.

9. The process of claim 8 wherein said chemically activated adhesive includes a non-melting chemically activatable adhesive.

10. The process of claim 9 wherein said adhesive is a vinyl acetate/acrylic copolymer.

11. A process for treating a carpet, said carpet including at least one backing material having a top face and an underside and pile comprising fibers and having a top surface and a thickness extending outwardly from said top face of said backing material, said process comprising:

(a) chemically activating a chemically activatable adhesive with a chemical activator; then (b) applying said adhesive to said pile to adhere said fibers to each other at points of adhesion along their lengths; and thereafter (c) removing any excess of said chemical activator from said pile.

12. The process of claim 11 wherein said chemical activation step includes forming an emulsion of said chemically activatable adhesive.

13. The process of claim 12 wherein said application step is conducted in the presence of a wetting agent.

14. The process of claim 13 wherein said chemically activatable adhesive is a non-melting chemically activatable adhesive.

15. The process of claim 14 wherein said adhesive is a vinyl acetate/acrylic copolymer.

* * * * *